US005860229A

United States Patent [19]

Morgenstern

[11] Patent Number: 5,860,229

[45] Date of Patent: Jan. 19, 1999

[54] INLAY SOLE WITH MASSAGING KNOBS

[75] Inventor: Elke Morgenstern, Wiesbaden, Germany

[73] Assignee: Prodomo S.A., Luxembourg, Luxembourg

[21] Appl. No.: 696,953

[22] PCT Filed: Feb. 22, 1995

[86] PCT No.: PCT/EP95/00649

§ 371 Date: Oct. 18, 1996

§ 102(e) Date: Oct. 18, 1996

[87] PCT Pub. No.: WO95/22916

PCT Pub. Date: Aug. 31, 1995

[30] Foreign Application Priority Data

Feb. 24, 1994 [DE] Germany ..... 44 06 063.7

[51] Int. Cl.[6] ..... A61F 5/14; A43B 23/00

[52] U.S. Cl. ..... 36/141; 36/44

[58] Field of Search ..... 36/43, 44, 11.5, 36/141

[56] References Cited

U.S. PATENT DOCUMENTS

| | | | |
|---|---|---|---|
| 4,047,310 | 9/1977 | Hyeng Sunoo | 36/11.5 |
| 5,551,173 | 9/1996 | Chambers | 36/44 |
| 5,664,342 | 9/1997 | Buchsenschuss | 36/141 X |
| 5,694,705 | 12/1997 | Alonso Coves | 36/141 X |

FOREIGN PATENT DOCUMENTS

| | | | |
|---|---|---|---|
| 2052070 | 1/1993 | Canada | 36/141 |
| A-0558897 | 9/1993 | European Pat. Off. . | |
| A-0578618 | 1/1994 | European Pat. Off. . | |
| 2619410 | 11/1976 | Germany | 36/141 |
| U-8131085 | 4/1982 | Germany . | |
| A-3520956 | 1/1987 | Germany . | |
| U-9001492 | 5/1990 | Germany . | |
| 2193426 | 2/1988 | United Kingdom | 36/43 |
| 0002551 | 5/1987 | WIPO | 36/141 |

*Primary Examiner*—B. Dayoan

*Attorney, Agent, or Firm*—Pearne, Gordon, McCoy & Granger LLP

[57] ABSTRACT

An sole includes a soft-elastic lower layer (2) of an atoxic and organically compatible material, a flexible cover layer (1), e.g. naturally tanned leather, and knobs (5) made of elastically deformable material, the knobs being arranged in groups on the sole surface, their location being selected according to the aspects of reflex zone therapy, and the knobs being fixed in the lower soft-elastic layer.

16 Claims, 3 Drawing Sheets

INLAY SOLE WITH MASSAGING KNOBS

BACKGROUND OF THE INVENTION

The present invention relates to an inlay sole comprising a soft-elastic lower layer, a flexible cover layer, and separable knobs. Of U.S. Pat. No. 4,047,310 a sandal with an orthopaedically formed bending-resistant sole is known, a relatively thick soft-elastic layer of rubber or plastic being glued to its upper side. In this upper layer a large number of pegs, arranged uniformly in rows over the entire sole surface, is permanently embedded, its upper rounded ends protruding from this layer and exerting a massaging effect on the foot sole and/or on certain sole areas. The pegs consist of a hard plastic material and support themselves by a conically enlarged foot on the bending-resistance running sole.

In another sandal known a great number of pressure elements are pressed from above into the recesses, formed in a pregiven pattern on the entire surface of the insole or footbed sole, in order to reach acupressure effects. The knob-like pressure elements have a cylindrical or locally thickened shaft and an enlarged flat head with rounded surface. The pressure elements having a punctual acupressure effect may result in an individual influence on the nerves ending in the foot sole and/or they may be arranged in reflex zones corresponding to the foot sole's division. A basic disadvantage of these known shoe embodiments consists in that the acupressure effect is restricted to a certain shoe and the desired stimulation effect reduces after about two hours of wearing, thus requiring the shoes to be changed several times a day. Due to the insufficient anchoring possibility of its shafts, the exchangeable pressure elements cannot be used for stylish shoes, in particular ladies' shoes, having thin running soles. DE-OS 35 20 956 describes a reflex inlay sole in which a great number of pins is arranged uniformly and at larger distances in the sole, protruding over the sole's upper side for stimulation of certain reflex points on the foot sole of the wearer. The inlay sole consists of a lower layer of a pressure-elastic deformable material and of an upper tissue layer, having a large number of penetration openings for, the rigid pins made e.g. of wood. The wooden pins have a disk-like enlarged foot, which serves as a support on the elastic layer and sinks into this layer when pressure is applied. The two flexible layers are only interconnected at their outer edge by a seam, such that relative displacements of the two layers resulting from rolling on the foot during walking may lead to a tilting of the rigid wooden pins, resulting in painful pressure points.

The present invention is therefore based upon the task to improve an inlay sole of the known kind in such a way that an easy fixing and/or changing of the knobs in the desired zones is guaranteed over a long period of time and that the perfect function of the inlay sole with knobs is also guaranteed over a long period of time.

This object is solved by the features of the present invention.

Due to the fact that the enlarged foot of the knobs is fit into a corresponding recess in the lower layer and that the knobs have an enlarged head with rounded upper side, its diameter being slightly larger than the hole diameter, supporting itself with its edge on the flexible cover layer, it is possible to perform the insertion and/or removal of the knobs easily and quickly and a secure fixation of the knobs over a very long period of time is guaranteed.

SUMMARY OF THE INVENTION

The group arrangement of the knobs with relatively low intermediate distances results in a stimulation of the selected organs as the knob group as a whole stimulates the corresponding zones of the foot sole. During walking the flat covering layer, preferably made of smooth fine leather, permits sliding movements of the foot in the surface areas free from knobs, supporting the stimulating effects of the knob areas. As provided for by the invention the knobs may be fixed captively or separably in the lower soft-elastic layer and go through the adequately positioned holes in the upper leather layer, forming a press fit. This formation of the inlay sole offers the wearer the possibility to arrange the knobs only in such reflex zones,—marked on the bottom side of the inlay sole—whose relevant organs shall be stimulated. By changing or removing the knobs from time to time the relevant optimum wearing times can be kept and overreactions as well as obtusion effects may be prevented. In addition the invention permits the purposive stimulation of one or even several organs at the same time or one after the other by using only a single inlay sole. Due to the low thickness and flexibility the inlay sole as provided for by the invention may be used for all shoe types, such as normal walking shoes, fashionable shoes, such as high-heel ladies' shoes as well as work and sports shoes.

In order to guarantee a tight fit of the knobs in both sole layers in case of these knobs arranged separably in the inlay sole, the knobs preferably have a disk-like enlarged foot, fitting exactly into a correspondingly shaped recess on the bottom side of the lower layer when inserted, the outer side of the foot being flush with the outer side of the lower layer. The manually separable holding and/or fixation of the knobs in the inlay sole can still be improved by additional means, i.e. by adhesive means or by forming an enlarged knob head, being pressed from below through the slightly tighter holes in the upper leather layer by applying more pressure.

In order to facilitate a purposeful selection of certain reflex zones when positioning or re-positioning the knobs, the reflex zones belonging to the individual organs are particularly marked e.g. by imprinted or raised borderings, hatchings or the like and designated by symbols, if required.

Further suitable designs and developments of the inlay sole as provided for by this invention are given in the sub-claims.

BRIEF DESCRIPTION OF THE DRAWINGS

Preferred embodiment examples of the invention are detailed below.

DETAILED DESCRIPTION

Figure 3:
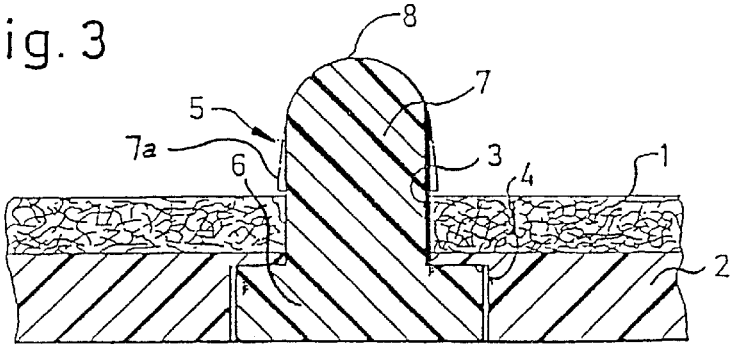
FIG. 3 shows a magnified section of the inlay sole.
Figure 4:
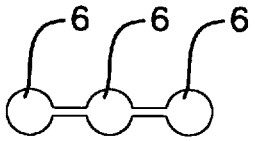
FIG. 4 shows in bottom view the enlarged feet (6) of several knobs (5) connected together.
Figure 5:
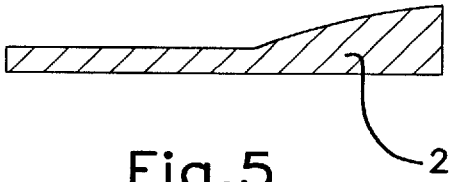
FIG. 5 shows a sectional view taken laterally in the middle of the lower layer (2) in the arch area showing a variable thickness adapted to the foot sole arch.
Figure 6:
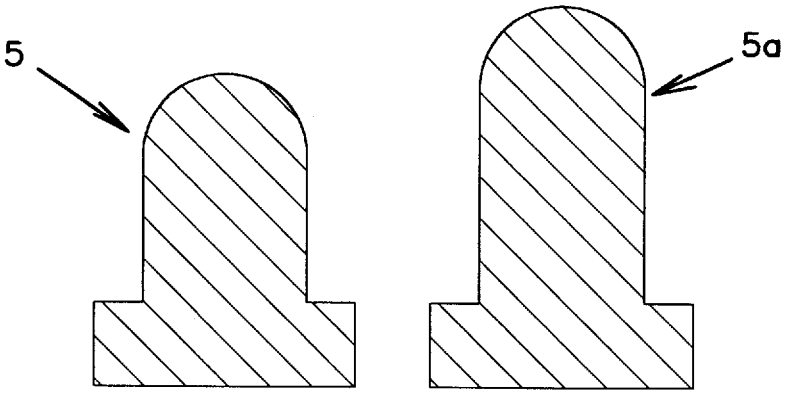
FIG. 6 shows in a sectional view knobs 5 and 5*a* having different lengths.
Figure 7:
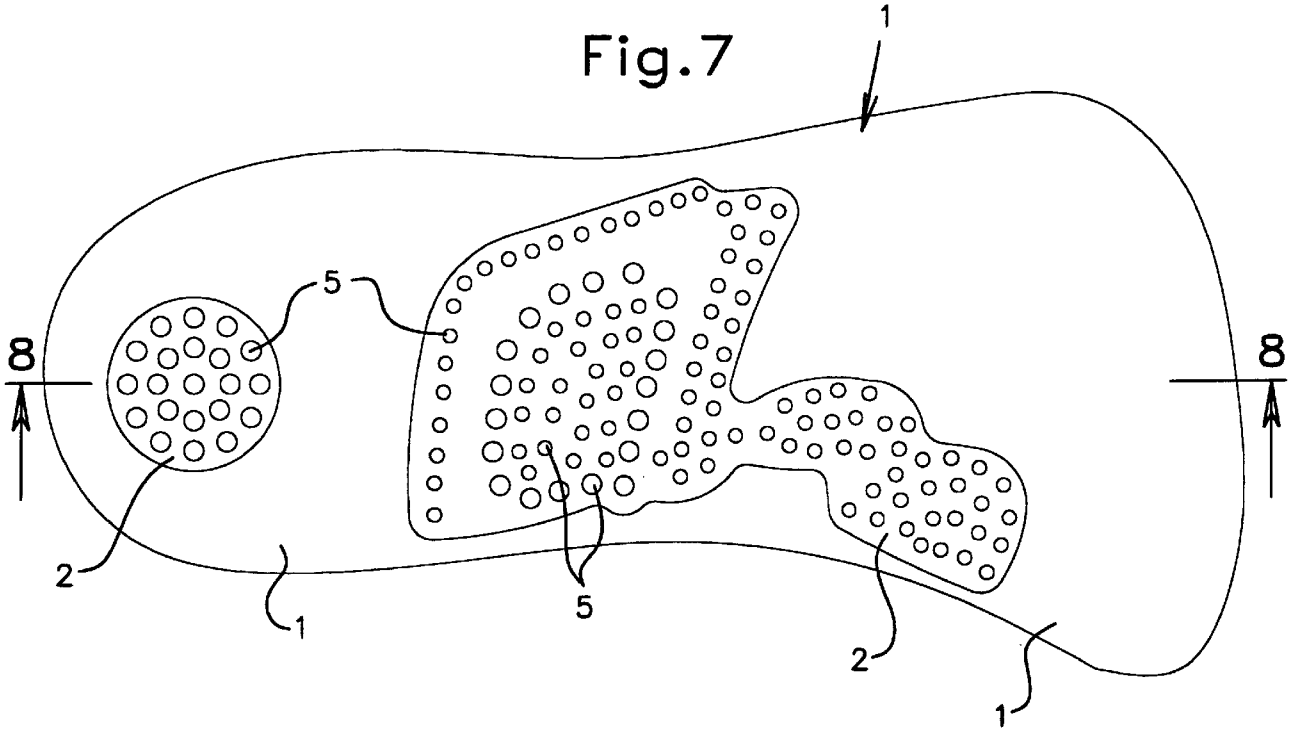
FIG. 7 shows in a plan view inseparable knobs (5) which are formed directly to the lower layer (2) and in the upper cover layer (1) the areas studded with these inseparable knobs are left free.
Figure 8:
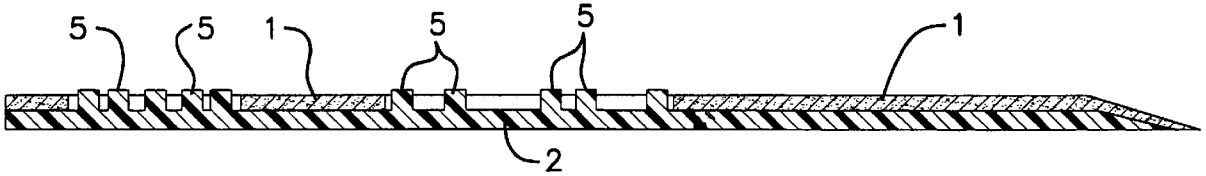
FIG. 8 shows a sectional view taken along line 8—8 of FIG. 7.

The inlay sole depicted consists of an upper leather layer 1 and a lower layer 2 of a soft-elastic atoxic material, such as caoutchouc in particular, rubber or relatively soft plastic. The materials of both layers shall not contain substances which might cause or result in undesired reactions of sensitive wearers, such as allergies. In the upper leather layer 1 a large number of holes 3 with a predetermined diameter of e.g. 1.0 to 3.0 mm has been punched in a certain pattern. In the lower soft-elastic layer 2 preferably circular recesses 4, corresponding in number to the holes 3, are formed in an axially centred way to each hole 3, extending up to leather layer 1 or—as shown in FIG. 3—ending shortly before it. In an optional number of these holes 3 and recesses 4 knobs 5 of an atoxic elastically deformable material may be fixed, having an enlarged foot 6, a cylindric shaft 7 and a rounded head 8 (see FIG. 3). The shape of foot 6 is exactly adapted to that of the recesses 4 and the diameter of shaft 7 is equivalent to or slightly larger than the diameter of holes 3. Due to this shape each knob 5 may be pressed by hand from below into a recess 4, its shaft 7 going into the relevant hole 3 in press fit and its head 8 protruding to a predetermined degree over the sole surface.

Figure 2:
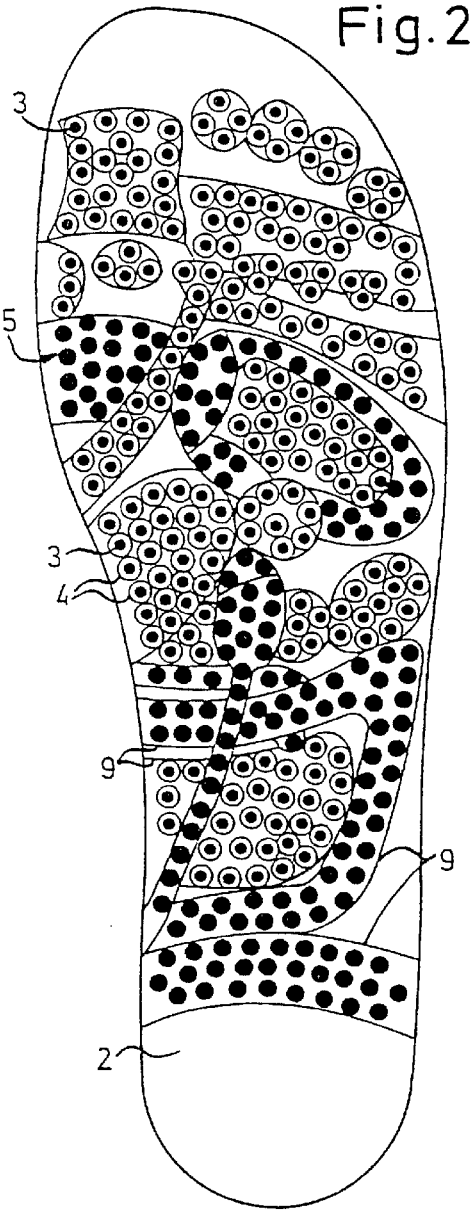
FIG. 2 shows the inlay sole according to FIG. 1 in bottom view.

As can be seen in FIG. 2, the sole bottom side is subdivided by imprinted or raised lines 9 in a variety of different areas, opposing the known reflex zones on the foot sole of the wearer. The individual reflex zone areas may be marked e.g. by numbers, letters or other symbols and on a free surface of the sole upper or bottom side the relevant body organs may be designated.

Figure 1:
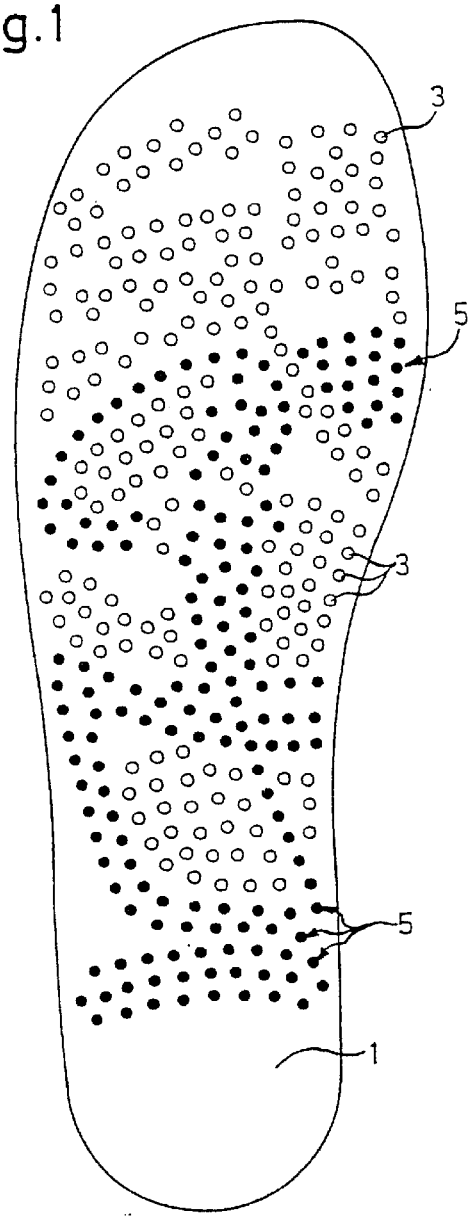
FIG. 1 shows a left inlay sole in top view.

In FIG. 1 and 2 it can be seen that in certain reflex zone areas which can be chosen freely by the wearer, knobs 5 shown only in black are arranged, such that only the organs attributed to these areas will be stimulated during walking. As it turned out that the reflex zone massage of foot soles by knobs or pins should not exceed certain time periods in order to prevent overstimulations or even obtusions, the knobs 5 of the inlay soles as provided for by the invention may be pulled out of the sole by the wearer after a predetermined wearing time of about 1 to 3 hours, or they may be repositioned in order to stimulate other organs.

The invention is not limited to the embodiment example depicted. The knobs may also be connected firmly to the lower sole layer. In addition the feet of several knobs may be interconnected and form a planar area, fitting into an adequately formed recess in the lower layer. When these knobs are not used the recess may be filled by an adequately formed rubber tab, to prevent through-treading. Although the inlay sole preferably should have the same thickness, certain areas, e.g. the instep, may be formed thicker or stiffened by a dimensionally stable domed base for achieving an orthopaedic supporting function. In addition further means for an improved fixation of the knobs in its recesses may be provided. Among theses means are e.g. a slightly thicker formation of the knob head (as shown in FIG. 3 by hatched lines), just allowing it to be pressed through hole 3 and forming on its lower end a ring flange for support on the leather cover layer 1.

In case of the inlay soles with inseparable and separable knobs fixed on the lower sole layer, as provided for by this invention, it is essential that not individual knobs exert an approximately point-shaped intensive massaging effect as is state of the art - , but due to the knob's group arrangement surface zones of the foot sole are stimulated gently and thus the relevant organs will be stimulated to an increased activity. This is particularly valid for the preferred field of appplication of the inlay sole as provided for by the invention, i.e. as an aid for reducing weight. In accordance with consolidated findings of reflex zone therapy the group arrangement of the knobs in the sole areas, belonging to the digestive organs stomach and intestines as well as liver, kidney and urinary duct, results in the fact that these organs will be stimulated to an increased activity by the temporary wearing of the inlay soles, leading to an accelerated excretion of digestive products and liquids and thus a reduced utilization of the valuable substances.

What is claimed is:

1. Inlay sole comprising a soft-elastic lower layer (2), a flexible cover layer (1) distinct from said lower layer (2), and separable knobs (5), the separable knobs being fixed captively and held separably in the lower layer (2) and being arranged in groups with small intermediate distances in areas of the inlay sole selected according to the aspects of reflex zone massage, the separable knobs in the inlay sole having an enlarged foot (6), characterized in that the enlarged foot (6) of each said separable knob is fit into a corresponding recess (4) in the lower layer (2), and each said separable knob extending through a hole in said flexible cover layer and having an enlarged head **(7*a*) with rounded upper side, said enlarged head having a diameter, each said hole having a diameter, said enlarged head's diameter being slightly larger than said hole's diameter, said enlarged head having a lower edge and supporting itself with its lower edge on the flexible cover layer (1)**.

2. Inlay sole according to claim 1, characterized in that the various reflex zones of the wearer's foot are marked by lines (9) on a sole surface.

3. Inlay sole according to claim 1, characterized in that the enlarged feet (6) of several knobs (5) are connected to a plane formation, being fit in a recess, formed in the lower layer.

4. Inlay sole according to claim 1, characterized in that the knobs (5) consist of different organically compatible materials.

5. Inlay sole according to claim 1, characterized in that the lower layer (2) has a variable thickness adapted to the foot sole arch.

6. Inlay sole according to claim 1, characterized in that the knobs (5) have different lengths.

7. Inlay sole according to claim 1, further comprising inseparable knobs which are formed directly to the lower layer (2) and in the upper cover layer (1) the areas studded with these inseparable knobs are left free.

8. Inlay sole according to claim 2, characterized in that the enlarged feet (6) of several knobs (5) are connected to a plane formation, being fit in a recess, formed in the lower layer.

9. Inlay sole according to claim 2, characterized in that the knobs (5) consist of different organically well-tolerated materials.

10. Inlay sole according to claim 2, characterized in that the lower layer (2) has a variable thickness adapted to the foot sole arch.

11. Inlay sole according to claim 3, characterized in that the lower layer (2) has a variable thickness adapted to the foot sole arch.

12. Inlay sole according to claim 4, characterized in that the lower layer (2) has a variable thickness adapted to the foot sole arch.

13. Inlay sole according to claim 2, characterized in that the knobs (5) have different lengths.

14. Inlay sole according to claim 3, characterized in that the knobs (5) have different lengths.

15. Inlay sole according to claim 4, characterized in that the knobs (5) have different lengths.

16. Inlay sole according to claim 5, characterized in that the knobs (5) have different lengths.

* * * * *

UNITED STATES PATENT AND TRADEMARK OFFICE

CERTIFICATE OF CORRECTION

PATENT NO. : 5,860,229

DATED : January 19, 1999

INVENTOR(S) : Elke Morgenstern

It is certified that error appears in the above-identified patent and that said Letters Patent is hereby corrected as shown below:

On the title page, Item [75], line 1, "Wiesbaden" should be --Hamburg--.

Column 1, line 5, after "knobs." insert a new paragraph as follows --The prior art includes DE-U-90 01 492.--

Column 1, line 40, after "for" delete --,--.

Column 3, line 58, insert " - " after --effect--.

On the title page, Item [57], Abstract, line 1, before "sole" insert --inlay--.

Signed and Sealed this

First Day of June, 1999

*Attest:*

Q. TODD DICKINSON

*Attesting Officer*

*Acting Commissioner of Patents and Trademarks*